United States Patent [19]

Talaski

[11] Patent Number: 5,039,284

[45] Date of Patent: Aug. 13, 1991

[54] FUEL PUMP WITH A VAPOR VENT VALVE

[75] Inventor: Edward J. Talaski, Caro, Mich.

[73] Assignee: Walbro Corporation, Cass City, Mich.

[21] Appl. No.: 520,553

[22] Filed: May 8, 1990

[51] Int. Cl.[5] ..... F04B 39/06

[52] U.S. Cl. ..... 417/366; 417/435; 123/516; 415/55.1; 415/146; 137/516.27

[58] Field of Search ..... 417/366, 435, 902; 123/516; 415/55.1, 146; 137/516.25, 516.27

[56] References Cited

U.S. PATENT DOCUMENTS

| | | | |
|---|---|---|---|
| 3,354,898 | 11/1967 | Barnes | 137/543.17 X |
| 4,569,637 | 2/1986 | Tuckey | 417/435 X |
| 4,591,311 | 5/1986 | Matsuda et al. | 417/366 X |
| 4,619,588 | 10/1986 | Moore, III | 417/366 |
| 4,692,092 | 9/1987 | Matsuda et al. | 417/366 X |
| 4,793,766 | 12/1988 | Kumata | 417/366 X |
| 4,822,258 | 4/1989 | Matsuda et al. | 417/366 X |
| 4,934,914 | 6/1990 | Kobayashi et al. | 417/423.3 |
| 4,940,397 | 7/1990 | Kuhlen | 123/516 X |

*Primary Examiner*—Leonard E. Smith
*Assistant Examiner*—Eugene L. Szczecina, Jr.
*Attorney, Agent, or Firm*—Barnes, Kisselle, Raisch, Choate, Whittemore & Hulbert

[57] ABSTRACT

A positive displacement type pump for use in a fuel system of an internal combustion engine having a pump housing that includes a pump chamber and a vapor vent valve to allow vapor to flow out of the pump chamber. The vent valve includes a valve seat, a valve and a spring biasing the valve away from the valve seat. During pump operation, the liquid fuel flow pressure within the pump chamber is great enough to seat the valve and prevent fuel from escaping through the vapor vent valve. However, if the internal pressure drops due to a loss of pumping pressure caused by the ingestion of air or vapors, the vent valve automatically opens to allow vapor or air flow through the pump with a resultant cooling effect on the pump assembly.

2 Claims, 2 Drawing Sheets

FUEL PUMP WITH A VAPOR VENT VALVE

FIELD OF INVENTION

This invention relates to fuel pumps for installation in the fuel tank of an internal combustion engine, and more particularly, a fuel pump having a vapor vent valve.

BACKGROUND OF THE INVENTION

Fuel pumps for internal combustion engines are used to deliver fuel from a fuel tank to a carburetor. These fuel pumps are frequently mounted in the fuel tanks of the vehicle and therefore are manufactured to sustain a wide range of ambient temperatures.

Generally, fuel pumps are powered by an electric motor having an armature mounted inside the fuel pump housing. A pumping mechanism, such as a positive displacement type, is coupled to the armature of the electric motor and draws fuel through an inlet port and pumps the fuel to an outlet port. The pumping mechanism and electric motor, enclosed within the pump housing, generate heat within the housing and is cooled by the fluid fuel flowing through the pump housing. If the vehicle has been operating for a period of time with no fluid flow in the system, the heat generated by the pumping mechanism and electric motor is trapped within the pump housing by the pump outlet valve and can potentially cause damage to the electric motor.

The problem which has been observed occurs when the engine is running but there is no net flow of fluid through the pump. The engine may run on due to residual pressure in the lines from air and vapor. Meanwhile, the pump may be running but there is no net cooling flow resulting from the flow of liquid fuel. The proposed valve is sensitive to this condition and opens automatically when the internal pump pressure drops. A conventional ball-type valve will not always open, thus causing an overheat condition.

SUMMARY OF THE INVENTION

It is an object of this invention to provide a pump construction that cools the internal working parts of the pump when liquid fuel is not flowing through the pump housing.

It is a feature of the invention to have a vapor vent valve which automatically opens under low pressure conditions to allow vapors to flow through the pump housing to cool the electric motor of the pump.

A pump housing for a fuel pump, in accordance with the present invention, includes a fuel inlet portion having an inlet port, a fuel outlet portion having an outlet port, a pump chamber disposed between the inlet portion and the outlet portion enclosing a pumping mechanism coupled to an electric motor to pump fuel from the inlet port to an outlet port, and the outlet portion also includes a valve-controlled opening that communicates the interior of the pump chamber with the ambient environment surrounding the pump housing. A vapor vent valve positioned in that opening has a valve seat mounted in the opening, a shaped valve aligned with the valve seat, and a spring biasing the valve away from the valve seat. This valve opens automatically under low pressure conditions to allow vapor from the pump chamber to vent out through the valve seat to the ambient environment, thus cooling the pump assembly.

In accordance with one important aspect of the invention, the vapor vent valve is constructed and arranged so that, under the conditions above described, vapor may flow past the valve and out through the valve seat to the ambient environment. When liquid fuel is being delivered from the inlet port to the outlet port of the outlet portion, forces on the valve are increased in the pumping chamber which moves the vapor vent valve against a seat, thus preventing fuel from exiting to the ambient environment.

Other objects and features of the invention will be apparent in the following description and claims in which the invention is described together with details to enable persons skilled in the art to practice the invention, all in connection with the best mode presently contemplated for the invention.

BRIEF DESCRIPTION OF THE DRAWINGS

Drawings accompanying the disclosure, and the various views thereof may be briefly described as.

DETAILED DESCRIPTION OF THE PREFERRED EMBODIMENT

Figure 1:
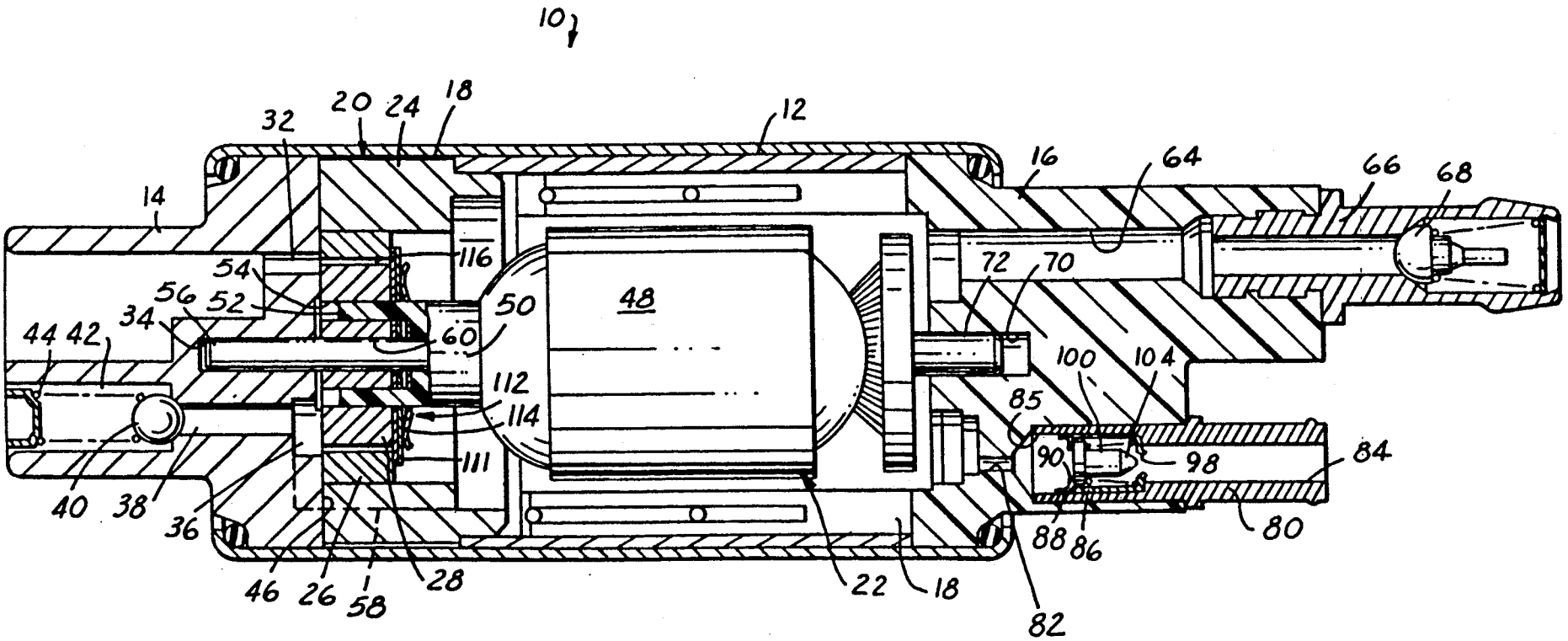
FIG. 1 is a lengthwise section of a fuel pump assembly.

The preferred embodiment of the present invention is illustrated by way of example in FIGS. 1–4. With specific reference to FIG. 1, an electric motor fuel pump assembly 10 has a cylindrical pump housing 12 with an inlet end portion 14, an outlet end portion 16 and a pump chamber 18. The pump chamber 18 encloses the fuel pumping mechanism assembly 20 coupled to an electric motor 22. In this particular embodiment 10, the pumping mechanism assembly 20 is a positive displacement type that includes a cam ring 24, an outer gear 26 within the cam ring 24, and a mating inner gear 28.

Inlet end portion 14 of the pump shown at the left end of FIG. 1, has a fuel inlet port 32, a centrally located bore 34, and a fuel outlet recess 36 which is in communication with a fuel relief passage 38 that is blocked by a check ball 40 disposed in a passage 42 and urged against passage 38 by spring 44. A fuel passage 58 through cam ring 24 is adjacent outlet recess 36 and opposite relief passage 38.

As shown in FIG. 1, pumping mechanism assembly 20 enclosed by pump chamber 18 is adjacent to the inner wall 46 of inlet end portion 14. The electric motor 22 has an armature 48 with a drive extension 50 that has circumferentially spaced fingers 52 received in axial holes 54 in inner gear 28. A stub shaft 56 extends through a central bore 60 on inner gear 28 and into bore 34 of inlet portion 14, both bores 34, 60 providing a journal for armature drive extension 50.

As viewed in FIG. 1, outlet end portion 16 is coupled to the right hand side of pump chamber 18. Outlet end portion 16 has an axially extending outlet passage 64 that leads to a fuel line connector 66 containing an outlet check valve 68. Outlet end portion 16 also provides a bearing recess 70 for a shaft 72 at the other end of armature 48.

Pressed against the pumping mechanism assembly 20 is a circular flexible sheet 111 (see FIG. 1). This circular sheet 111 is held firmly against and rotates with the outer gear 26 and inner gear 28, thereby forming a good seal and eliminating any axial clearance, and at the same time causing very little friction. Behind this sheet 111 is a multi-legged spider spring 112 having a umber of bent legs 114. The legs 114 of spider spring 112 interfit with circumferential fingers 52 and are pressed against sheet 111 when the parts are brought into assembly.

Figure 2:
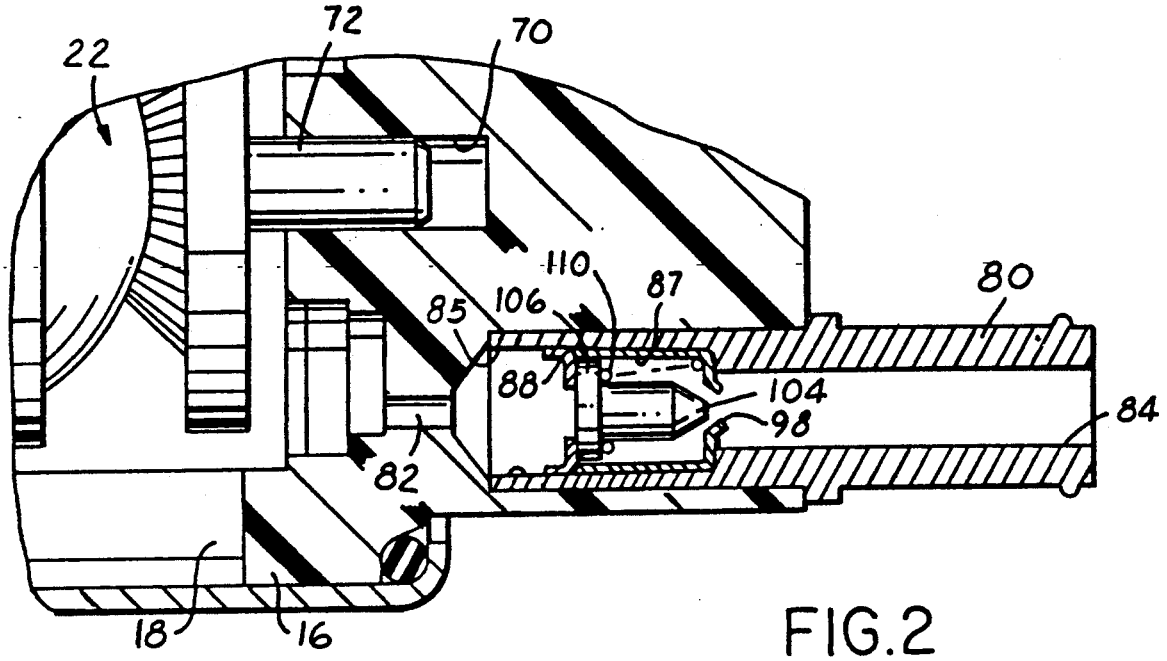
FIG. 2 is a partial section of an outlet end of the pump of FIG. 1.
Figure 3:
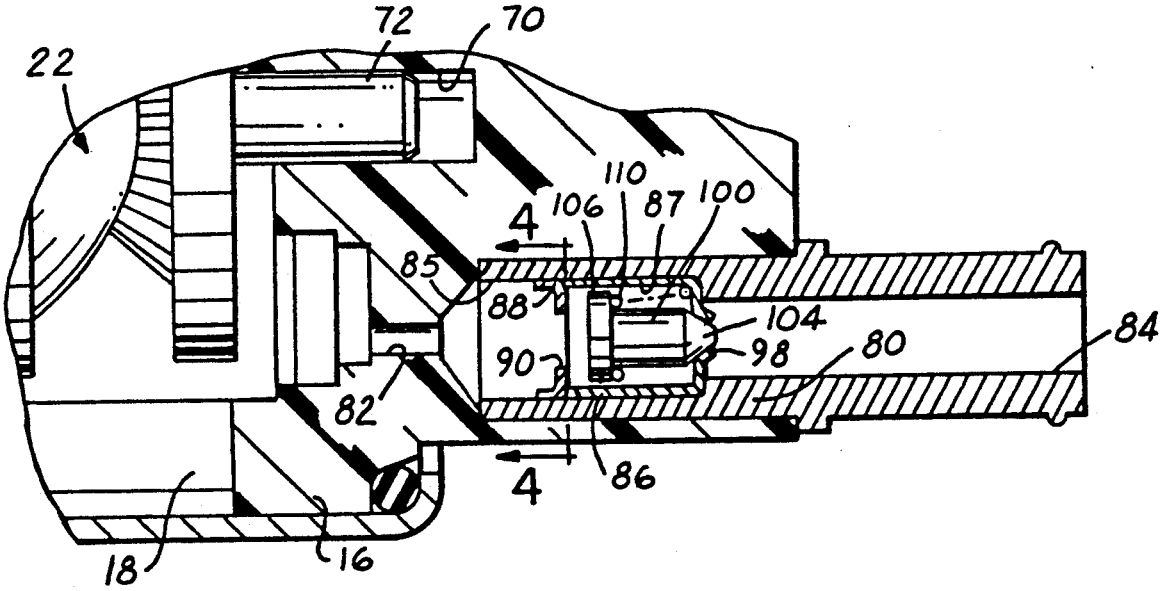
FIG. 3 is a partial section of the outlet end of the pump of FIG. 1 showing another operating position.
Figure 4:
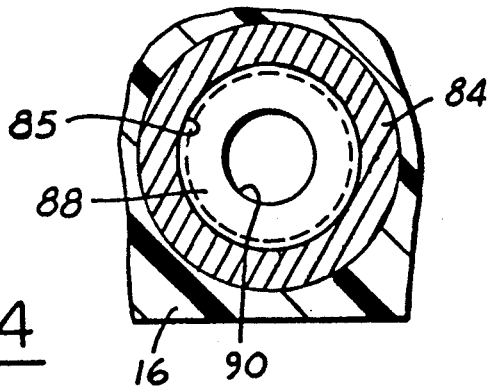
FIG. 4 is a sectional view on line 4—4 of FIG. 3.

As shown in detail in FIGS. 2 and 3, outlet end portion 16 has an axially extending outlet guide fitting 80 adjoining a vapor vent passage 82 that is in communication with the interior of pump chamber 18. Guide fitting 80 includes a passage 84 which leads to an enlarged bore 85 open to vent passage 82.

As detailed in FIGS. 2 and 3, within the bore 85 are two inserts, the first being a tubular brass insert 86 having a small opening 98 at one end flanged outwardly to form a valve seat. This insert 86 has a cylindrical inner surface 87 and can be molded into the guide fitting 80 as it is formed. The second insert is an apertured stop 88 having an opening 90 pressed in to the bore 85 against the open end of the insert 86. This insert 88 serves as a stop for a valve element 100 which can shuttle in the inner surface of the brass insert 86. The valve 100 has a main body portion which has a tapered end 104 to cooperate with the valve seat 98. At the other end of the valve 100 is a head portion 106, larger than the opening 90, which serves as a base for one end of a coil spring 110, the other end of the spring biasing against the inner end of the insert 86.

Thus, the coil spring urges the valve 100 to an open position away from seat 98 but is responsive to pumping pressure to close the seat 98. The head 106 of the valve is dimensioned to have outside clearance within the bore 87 in insert 86 and this clearance will be calibrated along with the spring rate so that the valve will shuttle to essentially an open position when pressure in the pump decreases from normal pumping pressure. However, vapor or air in the pump can move through the valve under low pressure conditions to carry heat away from the pump and prevent damage.

In a dry start operation, the fuel is introduced into the pump housing 12 through fuel inlet port 32 of inlet end 14. Electric motor 22 rotates armature 48, drive extension 50 and fingers 52 to drive inner gear 28. As both outer gear 26 and inner gear 28 rotate, a low pressure is created in the fuel intake area 116 of the gear rotor combination drawing fuel from inlet port 32 into roots of both inner and outer gears. Fuel is placed under pressure as the inner gear teeth move into outer gear roots. Fuel is squeezed between the roots and teeth of the meshing gears into outlet recess 36 and into the pump chamber through an axially extending passage 58 in cam ring 24.

As the fuel fills the pumping chamber 18, vapor within the pumping chamber 18 is moved around the valve head 106 to the outlet 84 (see FIG. 2). When the pumping chamber is filled with liquid fuel, the fuel also enters the vapor vent passage 82 and flows into stop opening 90. The liquid fuel passing through stop opening 90 and through the annular opening around valve head 106 causes the valve tip 104 to shuttle and seal against opening 98 of sleeve 86 (see FIG. 3). The seating of the valve tip 104 reduces the overall balanced load on the valve but there is an effective area which holds the valve in closed position as long as liquid fuel is acting on it under outlet pressure. This seating of the valve prevents liquid fuel from escaping through the outlet guide fitting 80 but also allows pressure to build up in chamber 18 and this fuel passes through the pumping chamber out through the main outlet port 66. Thus, the flowing liquid fuel cools the electric motor 22.

When an engine is running low on fuel so vapor and air begin to pass through the pump while the pump is still operating, there is then a need to by-pass the vapor to continue a cooling effect. With a conventional gravity controlled by-pass ball valve, the operation is erratic since the ball will not infrequently fail to open under these circumstances and the internal pump pressure does not drop low enough to allow the ball to drop to an open position. Thus, there is no cooling effect. A prolonged condition of this kind may cause overheating of the pump and resultant damage. In addition, the gravity biased ball may be affected by road conditions.

With the valve disclosed herein, vapor by-pass can be achieved in a manner to allow continued flow through the pump. A reduction in internal pump pressure caused by the pumping of air or vapors allows the force of spring 110 to overcome the pressure force on valve head 106, thus causing the valve 100 to shuttle to a position opening valve seat 98 but not closing opening 90. Thus, vapor can by-pass through seat 98 to provide a cooling effect.

Because the valve 104 is normally urged to an open position (see FIG. 2), it is desirable that vapors within the pump chamber 18 flow past the armature 48 of the electric motor 22 thereby absorbing heat from the armature 48 and carrying the heat out of the pumping chamber 18 through the outlet guide fitting 80 to the ambient environment. When the fuel pump 10 is re-started, the pumping mechanism 20 fills the pump chamber 18 with liquid fuel. The valve 100 being open allows residual vapor to be displaced through the guide fitting 80. When the pump fills with fuel, and vapor is dispersed, the rising fuel pressure acts on the valve 100 to move the valve tip 104 to seal against the valve seat opening 98 (see FIG. 3). If the valve head 106 is exposed to air or vapor and the pressure within the pump chamber 18 falls below a predetermined value, the spring will cause the valve 100 to shuttle toward stop 88 but will remain open a sufficient amount to allow vapor to exit to the ambient environment and provide a cooling function for the interior of the pump.

It should be noted that the axial location of the valve 100 is dependent upon the pressure gradient between the pump chamber and the ambient chamber surrounding the pump. Several factors can be taken into account when designing the vent valve assembly to achieve the intended performance. Within the fixed valve bore 87 in insert 86, the area of the valve head 106 can be increased or decreased to respectively decrease or increase the amount of fuel flow needed to shuttle the valve 100 closed at seat 98. The force of the spring 110 and the area of valve seat 98 can be selected so that the valve 100 will open at predetermined low vapor pressures to by-pass vapors without causing the valve to shuttle to a closed position at seat 98.

A special fitting 80 need not necessarily be provided since the opening for the valve sleeve and the valve seat may be molded into a plastic part of the pump assembly at any convenient location.

It is also to be understood that the terminology as employed in the description and claims incorporated herein such as "left", "right", "outer", "inner", etc., is used by way of description and not by way of limitation, to facilitate understanding of the structure, function and operation of the combination of elements which constitute the present invention. Moreover, while the foregoing description and drawings illustrate in detail one successful working embodiment of the invention to those skilled in the art to which the present invention relates, the present disclosure will suggest many modifications in the construction as well as widely differing embodiments and applications without thereby departing from the spirit and scope of the invention. The present invention, therefore, is intended to be limited only to the scope of the appended claims and applicable prior art.

The invention claimed is:

1. A pump housing for a fuel pump comprising:

a fuel inlet portion having an inlet port, a fuel outlet portion having an outlet port, a pump chamber disposed between said inlet portion and said outlet portion enclosing a pumping mechanism coupled to an electric motor to pump fuel from said inlet port to said outlet port; and venting means associated with said pump housing comprising a vent opening and a resiliently biased shuttle valve in said opening responsive to vapor pressure below normal pump pressure for venting vapor within said pump chamber to an ambient environment and responsive to the pressure of liquid fuel to close said opening, said venting means including a valve chamber having:

(a) a first valve seat at one end open to atmosphere and a valve stop having a second seat at the other end of said valve chamber, said second seat having an effective opening substantially larger than the effective opening of said first seat, (b) a shuttle valve in said valve chamber having a head end at the end of said valve chamber adjacent said second seat, said head end being larger than said effective opening of said second seat to close said shuttle valve against said second seat, said shuttle valve having a second end opposite said head end of smaller dimension to cooperate with said first seat when moved against said first seat, and (c) a light spring seated at a first end in said valve chamber adjacent said first seat, positioned around said second smaller end of said valve and seated at a second end of said spring against said head end of said valve, whereby light vapor pressure in said pump will act through said second seat against the larger head end of said valve to move said valve sufficiently to pass said vapor to said first seat without closing said first seat, and the presence of liquid fuel under operating pressure will shuttle said valve to close said first seat.

2. A flowthrough pump housing for a fuel pump comprising:

(a) a fuel inlet portion having an inlet port, (b) a fuel outlet portion having a first outlet port leading to an engine, (c) a pump chamber disposed between said inlet portion and said outlet portion enclosing a pumping mechanism coupled to an electric motor to pump fuel from said inlet port to said outlet port, (d) a check valve in said first outlet port allowing one-way flow out of said pumping chamber to an engine and blocking reverse flow from an engine being supplied with fuel, (e) a second outlet passage connected to said pumping chamber for venting vapor from said chamber to allow cooling said pump by passage of vapor through the pump when liquid fuel is not being pumped, and (f) means in said second outlet to control vapor flow which comprised:

(1) a valve sleeve in said pump housing having an axial passage enlarged at an inner end, (2) a first valve cylindrical insert in said enlarged inner end having an inturned outer flange abutting the outer end of said enlarged inner end and reduced in diameter to form a valve seat opening, (3) a second valve insert in said enlarged inner end of said axial passage abutting an inner end of said first insert having an inturned flange to provide an annular valve stop with a central opening larger than said valve seat opening, (4) a shuttle valve in said first valve insert shorter in axial length that the distance between said annular valve seat opening and said stop and movable between said annular valve stop and said valve seat opening, said shuttle valve having an ensmalled end shaped to close said valve seat opening when said shuttle valve is moved toward said valve seat opening, and an enlarged head end on said shuttle valve larger in diameter than said central opening in said second valve insert to close said enlarged head end against said annular valve stop, (5) a coil spring means seated at one end on the inturned flange of said first valve insert and seated at the other end against said head end of said shuttle valve to urge said shuttle valve against said valve stop of said second valve insert, whereby, under conditions of non-operating pressure in said pump, vapor within said pump acting on the enlarged area of said head end of said shuttle valve will move said shuttle valve against said spring to allow vapor to pass said head end to the second outlet passage to cool said pump without closing said valve seat opening, and under conditions of operating pressure, the presence of liquid fuel will act on said head end to shuttle the valve to a position closing said valve seat opening.

* * * * *